US012805642B2

(12) United States Patent
Van Dijkman

(10) Patent No.: US 12,805,642 B2
(45) Date of Patent: Nov. 24, 2026

(54) ATTACHMENT ARRANGEMENT

(71) Applicant: Inter IKEA Systems B.V., Delft (NL)

(72) Inventor: Richard Van Dijkman, Hallaryd (SE)

(73) Assignee: Inter IKEA Systems B.V., Delft (NL)

( * ) Notice: Subject to any disclaimer, the term of this patent is extended or adjusted under 35 U.S.C. 154(b) by 0 days.

(21) Appl. No.: 18/854,631

(22) PCT Filed: Apr. 11, 2023

(86) PCT No.: PCT/SE2023/050326
§ 371 (c)(1),
(2) Date: Oct. 7, 2024

(87) PCT Pub. No.: WO2023/200384
PCT Pub. Date: Oct. 19, 2023

(65) Prior Publication Data

US 2025/0280962 A1 Sep. 11, 2025

(30) Foreign Application Priority Data

Apr. 11, 2022 (SE) ..... 2250452-6

(51) Int. Cl.
*A47C 17/17* (2006.01)
*A47C 17/20* (2006.01)

(52) U.S. Cl.
CPC ..... *A47C 17/17* (2013.01); *A47C 17/20* (2013.01)

(58) Field of Classification Search
CPC ..... A47C 17/17; A47C 17/20; A47C 17/26; A47C 17/04; A47C 1/0347; A47C 1/0342
See application file for complete search history.

(56) References Cited

U.S. PATENT DOCUMENTS 170,678 A 12/1875 Mackenzie
1,001,390 A * 8/1911 Gross ..... A47C 19/045 5/93.1

(Continued)

FOREIGN PATENT DOCUMENTS

CN 213344998 U 6/2021
DE 0158423 C 2/1905

(Continued)

OTHER PUBLICATIONS

Extended European Search Report and Search Opinion received for EP Application No. 23788692.4, mailed on Feb. 25, 2026, 7 pages.

*Primary Examiner* — Aaron R Eastman
(74) *Attorney, Agent, or Firm* — Dilworth IP, LLC

(57) ABSTRACT

An attachment arrangement for attaching a structural element to a supporting element of a piece of furniture operable between multiple configurations, the attachment arrangement including a longitudinal guiding arrangement for attachment to one of the structural element or the supporting element, and an engaging arrangement for attachment to the other of the structural element or the supporting element. The engaging arrangement includes a first engagement member and a second engagement member operable to, when used in the piece of furniture, engage the longitudinal guiding arrangement to provide a translation and a rotation (R) of the structural element in relation to the supporting element between a first configuration and a second configuration of the piece of furniture.

19 Claims, 7 Drawing Sheets

(56) References Cited

U.S. PATENT DOCUMENTS

| | | | | | |
|---|---|---|---|---|---|
| 2,136,320 | A | * | 11/1938 | Schwab, Jr. | A47C 17/17 5/47 |
| 3,113,325 | A | * | 12/1963 | Kamp | A47C 17/138 5/17 |
| 3,329,976 | A | * | 7/1967 | Heller | A47C 17/26 5/26.1 |
| 3,329,977 | A | * | 7/1967 | Heller | A47C 17/16 5/38 |
| 3,383,716 | A | | 5/1968 | Biancalani | |
| 4,051,564 | A | * | 10/1977 | Gudish | A47C 19/205 5/8 |
| 4,106,137 | A | * | 8/1978 | Leclerc | A47C 17/165 5/26.1 |
| 5,222,286 | A | * | 6/1993 | Saul | A47C 1/0355 29/434 |
| 2012/0131745 | A1 | * | 5/2012 | Wieland | A47C 17/62 5/2.1 |
| 2014/0130253 | A1 | * | 5/2014 | Sadeghi | A47C 13/00 297/311 |
| 2014/0373272 | A1 | * | 12/2014 | Baldassarra | A47C 17/175 5/29 |
| 2016/0296029 | A1 | * | 10/2016 | Salin | A47C 17/84 |
| 2021/0378407 | A1 | * | 12/2021 | Fromme-Ruthmann | A47C 17/52 |
| 2024/0415284 | A1 | * | 12/2024 | Nelson | A47C 1/124 |

FOREIGN PATENT DOCUMENTS

| | | | |
|---|---|---|---|
| GB | 190805855 | A | 9/1908 |
| GB | 386946 | | 1/1933 |
| GB | 475628 | | 11/1937 |

* cited by examiner

ATTACHMENT ARRANGEMENT

TECHNICAL FIELD

The present invention relates to an attachment arrangement and more precisely to an attachment arrangement for a piece of furniture allowing the piece of furniture to be operable in multiple configurations.

BACKGROUND

With the evolution of cities and the increase in prices of housing, many people are forced to live in a dwelling being smaller than they desire. There are also architectural and social movement (e.g. tiny/small-house movement) that advocates downsizing living spaces in order to simplify life and provide a more eco-friendly and less consumption oriented lifestyle.

With these smaller living accommodations, a need for smarter and more efficient usage of the living space becomes apparent. Living at a reduced area will make it challenging to furnish a home to have e.g. both a lounge area and a dining area. It may even be such that the only pieces of furniture available are a table and a bed where the bed has to function both as sofa, dining chair and sleeping arrangement. There are presently solutions available, e.g. day beds, murphy beds and futons, that may be configured to function as e.g. a sleeping arrangement and a sitting arrangement.

Multi-functional pieces of furniture are often bulky and the conversion from one configuration to another may be complicated and/or heavy. The mechanics involved in the conversion are generally complex and difficult to assemble making them costly to produce and transport.

SUMMARY

It is in view of the above considerations and others that the various embodiments of this disclosure have been made. The present disclosure therefor recognizes the fact that there is a need for improvement of the existing art described above.

An object of the present disclosure is to provide a new type of attachment arrangement which is improved over prior art and which eliminates or at least mitigates the drawbacks discussed above. More specifically, an object of the invention is to provide an attachment arrangement that is cost effective, intuitive and usable with pieces of furniture that are operable in multiple configurations. These objects are addressed by the technique set forth in the appended independent claims with preferred embodiments defined in the dependent claims related thereto.

In a first aspect, an attachment arrangement for attaching a structural element to a supporting element of a piece of furniture operable between multiple configurations is presented. The attachment arrangement comprises a longitudinal guiding arrangement for attachment to one of the structural element or the supporting element, and an engaging arrangement for attachment to the other of the structural element or the supporting element. The engaging arrangement comprising a first engagement means and a second engagement means operable to, when used in the piece of furniture, engage the longitudinal guiding arrangement to provide a translation and a rotation of the structural element in relation to the supporting element between a first configuration and a second configuration of the piece of furniture.

In one variant, when the attachment arrangement is used in the piece of furniture, the first engagement means is configured to provide a pivot point for rotation from the first configuration to the second configuration, and the second engagement means is configured to provide a pivot point for rotation from the second configuration to the first configuration. This is beneficial as the attachment arrangement will be more intuitive to use as the translation and the rotation will be in the same directions regardless of from which configuration the piece of furniture is changed.

In one variant, the first engagement means and/or the second engagement means is a rolling engagement means. Rolling engagement means provide a smooth and convenient translation and rotation as friction is reduced. Also, wear and tear of the engagement means and guiding arrangement will be reduced as friction is decreased.

In one variant, the first engagement means and/or the second engagement means is a sliding engagement means. A sliding engagement means is beneficial as it is comparably cheap and will reduce the cost of the attachment arrangement.

In one variant, the longitudinal guiding arrangement is provided with a first longitudinal member operable to, when used in the piece of furniture, support the engaging arrangement.

In one variant, the longitudinal guiding arrangement is further provided with a second longitudinal member arranged substantially parallel to the first longitudinal member. The longitudinal guiding arrangement is operable to, when used in the piece of furniture, sandwich one of the engagement means of the engaging arrangement between the first longitudinal member and the second longitudinal member during the translation of the structural element in relation to the supporting element. This is beneficial as it allows the engaging arrangement to be guided with more precision increasing the ease of use of the attachment arrangement and also provides a sturdier engagement between the guiding arrangement and the engaging arrangement. This increase the sense of quality of the attachment arrangement and also reduces play between the guiding arrangement and the engaging arrangement.

In one variant, the second longitudinal member is shorter than the first longitudinal member providing a longitudinal opening in the longitudinal guiding arrangement through which, when used in a piece of furniture (i.e. when in engagement), the first engagement means and the second engagement means are operable to pass. This allows for an intuitive process of converting the piece of furniture between the different configurations.

In one variant, the attachment arrangement comprises two longitudinal openings, wherein one longitudinal opening is provided at each longitudinal end of the longitudinal guiding arrangement and a longitudinal distance between the longitudinal openings is the same as a longitudinal distance between the first engagement means and the second engagement means. This allows for an intuitive process of converting the piece of furniture between the different configurations.

In one variant, the first longitudinal member and/or the second longitudinal member is formed with a U-shaped cross-section. This is beneficial as the engagement between the engaging arrangement and the guiding arrangement may be provided with reduced play increasing the sturdiness of the piece of furniture.

In one variant, the longitudinal guiding arrangement is provided with a longitudinal stop member configured to prevent the engagement means from, when engaging the longitudinal guiding arrangement, travel beyond the stop member.

In a second aspect, a piece of furniture operable between multiple configurations is presented. The piece of furniture comprising a structural element, a supporting element and an attachment arrangement according to the first aspect configured to attach one side of the structural element to the supporting element and to provide a translation and a rotation of the structural element in relation to the supporting element between a first configuration and a second configuration of the piece of furniture.

In one variant, the longitudinal guiding arrangement or the engagement arrangement attached to the structural element is arranged off-centered to a thickness extension of the structural element. This is beneficial as it will allow the structural element to be placed at different heights depending on the configuration. For instance, when a person is using the piece of furniture being in contact with the structural element, a distance from the attachment arrangement to the person will be different depending on the configuration of the piece of furniture.

In one variant, the piece of furniture comprises two attachment arrangements, one arranged at each side of the structural element and configured to attach the structural element to the supporting element. This provides a stable and sturdy attachment of the structural element to the supporting element and reduce a risk of skewing of the structural element during reconfiguration of the piece of furniture.

In one variant, the structural element is formed with a chamfer at one end along the extension of the attachment arrangement. This is beneficial as parts of the structural element may be hidden and fitted behind parts of the supporting element in some configurations of the piece of furniture.

In one variant, the one or more longitudinal guiding means are attached to the supporting element.

In one variant, the piece of furniture is a seating furniture comprising one or more seats and one or more backrests.

In one variant, at least one of said one or more seats is a structural element attached to the supporting element by the attachment arrangement.

In one variant, at least one of said one or more backrests is a structural element attached to the supporting element by the attachment arrangement.

In one variant, one of the first configuration or the second configuration is a lounge configuration.

In one variant, one of the first configuration or the second configuration is a dining configuration.

In one variant, one of the first configuration or the second configuration is a sleeping configuration.

BRIEF DESCRIPTION OF THE DRAWINGS

Embodiments of the invention will be described in the following; references being made to the appended diagrammatical drawings which illustrate non-limiting examples of how the inventive concept can be reduced into practice.

DETAILED DESCRIPTION

Hereinafter, certain embodiments will be described more fully with reference to the accompanying drawings. The invention may, however, be embodied in many different forms and should not be construed as limited to the embodiments set forth herein; rather, these embodiments are provided by way of example so that this disclosure will be thorough and complete, and will fully convey the scope of the invention, such as it is defined in the appended claims, to those skilled in the art.

The term "coupled" is defined as connected, although not necessarily directly, and not necessarily mechanically. Two or more items that are "coupled" may be integral with each other. The terms "a" and "an" are defined as one or more unless this disclosure explicitly requires otherwise. The terms "substantially," "approximately," and "about" are defined as largely, but not necessarily wholly what is specified, as understood by a person of ordinary skill in the art. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method that "comprises," "has," "includes" or "contains" one or more steps possesses those one or more steps, but is not limited to possessing only those one or more steps.

Figure 1A:
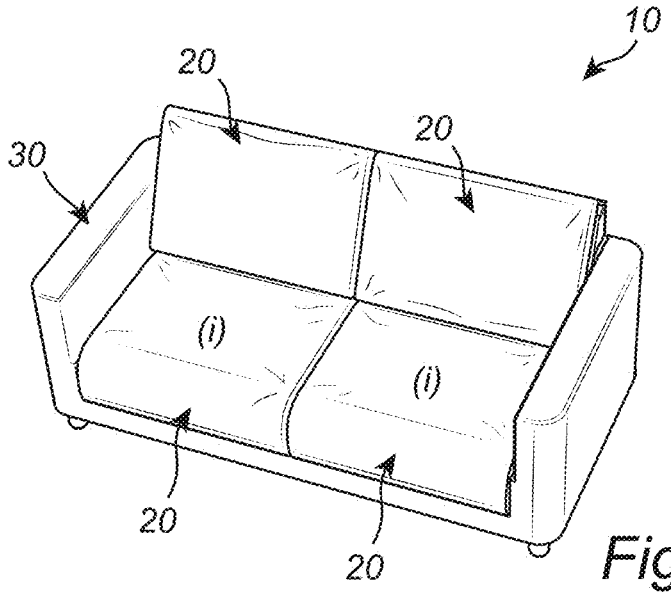
FIGS. 1*a-c* are perspective views of a piece of furniture operable between multiple configurations according to embodiments of the present disclosure.
Figure 1B:
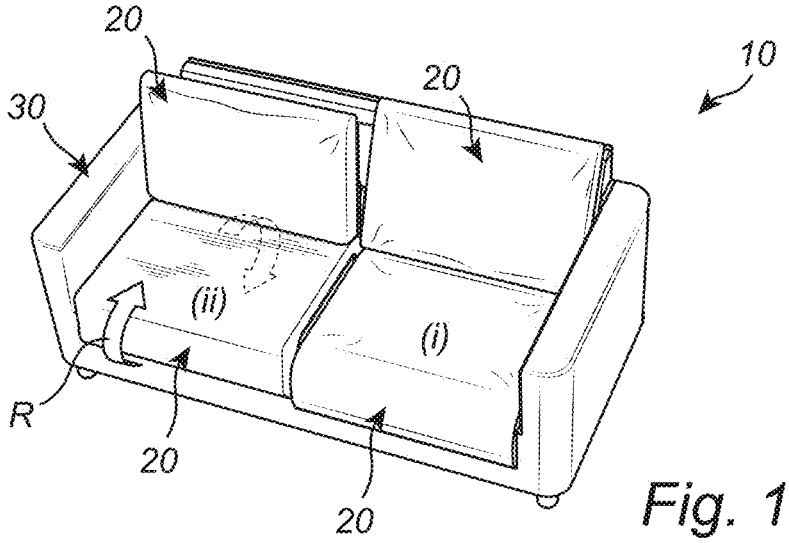
Figure 1C:
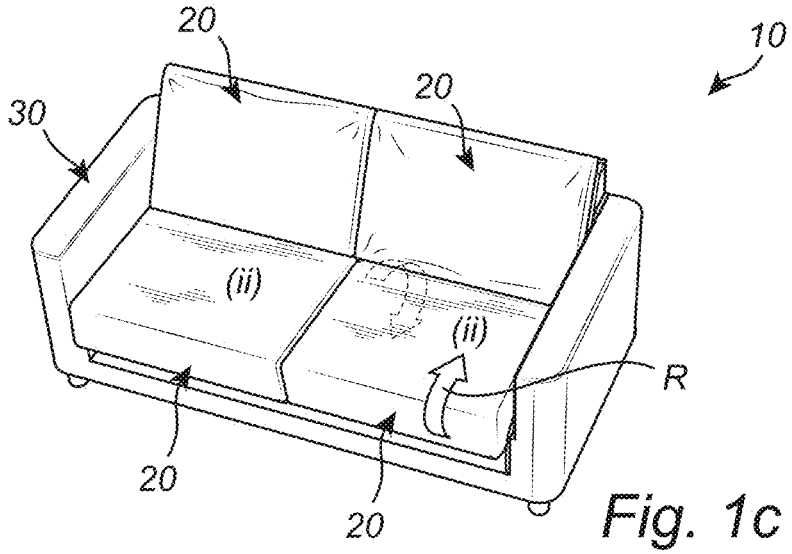

With reference to FIGS. 1*a-c*, a piece of furniture 10 operable between multiple configurations according to embodiments of the present disclosure will be presented. The piece of furniture 10 of FIGS. 1*a-c* is a sofa 10, but the teachings of the present disclosure are applicable to many other types of furniture operable between multiple configurations such as chairs, beds etc. The piece of furniture 10 comprises a supporting element 30 configured to support a plurality of structural elements 20. The supporting element 30 may be referred to as a frame 30 of the piece of furniture 10. The supporting element 30 may be referred to as a load bearing element of the piece of furniture 10. The supporting element 30 may be described as the element of the piece of furniture 10 that is fixed and not moved when changing the configuration of the piece of furniture 10. The piece of furniture 10 further comprises a structural element 20 attached to the supporting element 30. In the exemplary embodiment of FIG. 1*a*, the two-seat sofa comprises a total of four structural elements 20. Each seat is a structural element 20 and the backrest of each seat is a structural element 20. Although not shown, also a headrest may be considered a structural element 20. It should be emphasized that, for the teachings of the present disclosure, not all of the listed structural elements 20 of FIG. 1*a* are needed to be present, for the teachings to be applicable, it is sufficient that one structural element 20 and one supporting element 30 is provided. In other words, in some embodiments, only the seats of a sofa are structural elements 20 according to the present disclosure. In some embodiments, not all of the seats of the piece of furniture 10 are structural elements 20 according to the present disclosure.

In FIG. 1*a*, the seats of the piece of furniture 10 are illustrated in a first configuration (i). This first configuration (i) may, in some embodiments, be described as a lounge configuration. The lounge configuration is to mean that the piece of furniture 10 is configured, in the embodiment of the sofa, as a sofa for sitting and lounging. This generally implies that the seats are comparably low and typically incline downwards towards the backrest such that a person sitting on the sofa will be urged backwards into the sofa to a reclined position. In the lounge configuration, the seat may, in some embodiments, be softer compared to other configurations.

In FIG. 1*b*, the same piece of furniture 10 as in FIG. 1*a* is illustrated but with the left seat 20 and backrest 20 configured in a second configuration (ii). The second configuration (ii) may, in some embodiments, be described as a dining configuration. The dining configuration implies that the piece of furniture 10 is configured in the one of its configurations being most suitable for dining. Generally, when dining, a person prefers to sit more straight compared to when lounging. In FIG. 1*b*, this is illustrated by a height of the left seat being increased and that an angle of the backrest of the sofa has been changed. The seat is, in the dining configuration, more horizontal than in the lounge configuration and the backrest is more vertical than in the lounge configuration. This allows a person sitting on the sofa to be seated more straight than in the lounge configuration and consequently be able to more conveniently reach e.g. a table during dining. Additionally, a seat for dining is generally more firm than a seat for lounging which means that the dining configuration may be provided with a firmer seat than the lounge configuration.

It should be briefly mentioned that the angle of the backrest may be adjusted in accordance with the teachings of the present disclosure, but in some embodiments, the backrest may simply be pivotably mounted to the supporting element 30 at an end by the seat. The backrest may be pivoted about an axis parallel to a breadth extension of the sofa. In FIG. 1*b*, the left seat is illustrated as pivoted forward and in order to keep it at this position, a neck rest (not shown) or similar may be folded between the backrest and the supporting element 30 to keep the backrest from pivoting backwards when a force is applied to the backrest, i.e. when a person sitting on the sofa is leaning backwards.

In FIG. 1*c*, the same piece of furniture as in FIG. 1*a* is illustrated but configured in an alternative second configuration (ii). This second configuration may, in some embodiments, be described as a sleeping configuration. As the name suggest, in the sleeping configuration, the piece of furniture 10 is configured as a bed. When sleeping, a substantially horizontal positon is commonly preferred, and the seats are arranged, similarly to the dining position, substantially horizontally. One difference between the dining configuration and the sleeping configuration may be a firmness of the seat where the seat for dining is generally more firm than a seat or mattress for sleeping. In the dining configuration, it is generally preferred to maximize an area of the bed, and the backrests may be pushed away from the seats, into the sofa, at an end of the backrest by the seats.

Figure 2A:
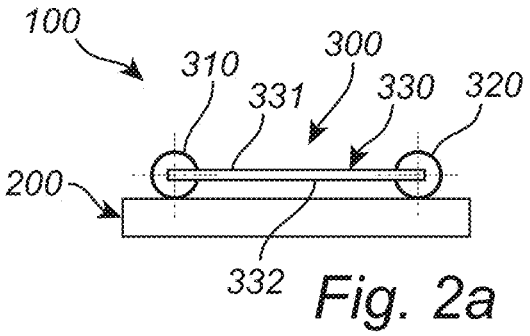
FIGS. 2*a-d* are schematic side views of an attachment arrangement according to embodiments of the present disclosure.

In order to make the reconfiguration of the piece of furniture 10 as smooth and convenient as possible without having to use complex and expensive mechanical solutions, the inventors behind the present disclosure have realized that by using an attachment arrangement 100 as exemplified in FIG. 2*a*, all these objectives are achieved. The attachment arrangement 100 comprises a longitudinal guiding arrangement 200 (guiding arrangement for short) and an engaging arrangement 300. The longitudinal guiding arrangement 200 is configured to guide the engaging arrangement 300. Preferably, the engaging arrangement 300 is attached to the structural element 20 of the piece of furniture 10 and the guiding arrangement 200 is attached to the supporting element 30. However, as will be explained with reference to FIGS. 3*a-d*, the opposite configuration is also possible and should be considered to form a part of the present disclosure, i.e, wherein the guiding arrangement 200 is attached to the structural element 20 of the piece of furniture 10 and the engaging arrangement 300 is attached to the supporting element 30.

Generally, each of the longitudinal guiding arrangement 200 and the engaging arrangement 300 are fixedly attached to one of the structural element 20 and the supporting element 30. By engagement of the engagement arrangement 300 with the longitudinal guiding arrangement 200, the structural element 20 is movably attached to the supporting element 30 by the attachment arrangement 100. The attachment between the structural element 20 and the supporting element 30 by the attachment arrangement 100 is such that the structural element 20 is supported by the supporting element 30. The attachment arrangement 100 is configured such that a load of the structural element 20 is transferred to the supporting element 30. To exemplify, if an attachment arrangement 100 according to the present disclosure is used to attach one side 20L, 20R (see FIG. 7*c*) of a seat 20 of a sofa 10 to a frame 30 of the sofa 10, that side of the seat would not require any additional load bearing features in order for the frame 30 to take the load of the seat 20. As will further explained elsewhere in the present disclosure, it may be beneficial to provide one attachment arrangement 100 at each side 20L, 20R of the seat 20 of the sofa 10.

In FIG. 2*a*, a cross-sectional view of the attachment arrangement 100 is shown where the engaging arrangement 300 is attached to the structural element 20 (not shown in FIG. 2*a*) and the guiding arrangement 200 is attached to the supporting element 30 (not shown in FIG. 2*a*) of the piece of furniture 10. The engaging arrangement 300 comprises a first engagement means 310 and a second engagement means 320. The engagement means 310, 320 are spaced apart by a longitudinal distance $L_{300}$. The longitudinal distance $L_{300}$ may be determined based on a configuration of the structural element 20 or the supporting element 30 that the engaging arrangement 300 is attached to. The engagement means 310, 320 may be directly attached to the structural element 20 or to the supporting element 30, or, as shown in FIG. 2*a*, interconnected by a interconnecting means 330. The engagement means 310, 320 may be connected to the element 20, 30 via the connection means 330. The interconnecting means 330 may be any suitable interconnecting element such as a bar, strip or rod with any suitable profile and made from any suitable material such as plastic, wood or metal. The interconnecting means 330 is shown in FIG. 2*a* as having a first longitudinal surface 331 facing vertically up, i.e. away from the guiding arrangement 200. An opposite second longitudinal surface 332 of the interconnecting means 330 is facing vertically down in FIG. 2*a*, i.e. towards the guiding arrangement 200. In FIG. 2*a*, the attachment arrangement 100 is shown in the first configuration (i), i.e. the piece of furniture 10 the attachment arrangement 100 is forming a part of (is comprised in) is configured in its first configuration (i). Assume for simplicity of explanation, that the structural element 20 to which the engaging arrangement 300 in FIGS. 2*a-d* is attached, is a seat of a sofa and that the first configuration (i) is a lounge configuration. Assume further that the front of the sofa is, as shown in FIG. 2*a*, towards the first engagement means 310 and the back of the sofa is towards the second engagement means 320.

Figure 2B:
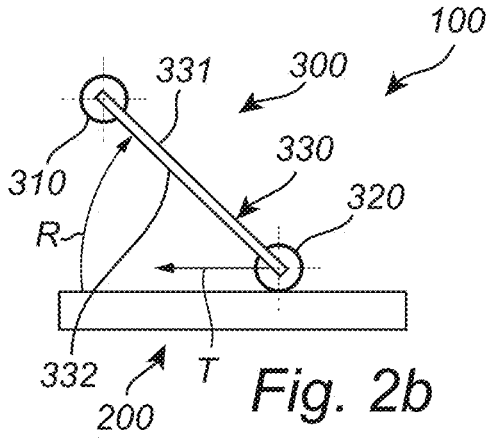
Figure 2C:
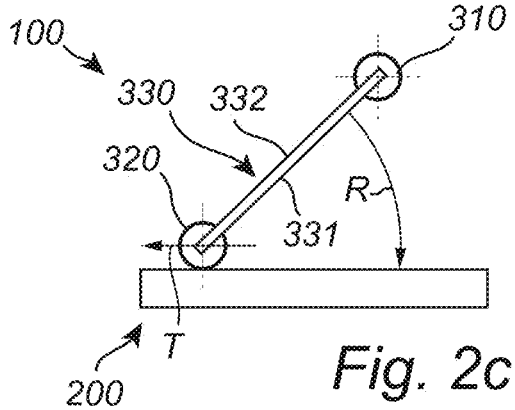

The transition of the attachment arrangement 100 (the piece of furniture 10) to the second configuration (ii) is illustrated in FIGS. 2*b* and 2*c*. The transition may be described as a transformation, a reconfiguration, a change of mode, a change of operable configuration etc. In FIG. 2*b*, the transition is initiated by a translation T and/or a rotation R of the engaging arrangement 300, i.e. of the structural element 20 exemplified by the seat of a sofa. In this embodiment, the order of initiation of the translation T and rotation R is of no particular importance. Preferably, the seat is lifted at the front of the sofa, which means that the first engagement means 310 is lifted from the guiding arrangement 200 causing a rotation R about the second engagement means 320. Before, after or in conjunction with this, the back of the seat is pulled towards the front of the sofa which means that the second engagement means 320 is longitudinally guided along the guiding arrangement 200 towards the front of the sofa, i.e. the translation T.

As seen in FIG. 2*c*, the translation T is continued until the second engagement means 320 is at a longitudinal end of the longitudinal guiding arrangement 200. Similarly, the rotation R continues until the first engagement means 310 is once more in contact with (or at least proximal to) the guiding arrangement 200.

Figure 2D:
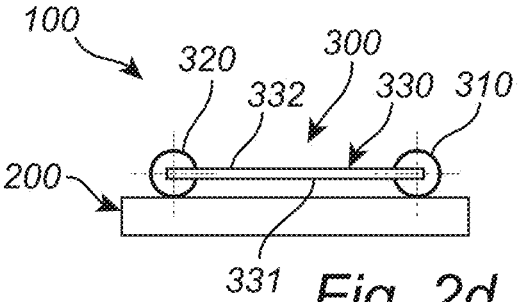

In FIG. 2*d*, attachment arrangement 100 is shown when the transition from the first configuration (i) into the second configuration (ii) has been completed. Compared to first configuration (i) of FIG. 2*a*, the second configuration (ii) is rotated 180 degrees about the engagement means 310, 320. As a result of the rotation R and the translation T, the first engagement means 310 and the second engagement means 320 have substantially changed positions with each other in relation to the guiding arrangement 200. The rotation R was illustrated in FIGS. 2*b* and 2*c* as a rotation R about the second engagement means 320, but the rotation R may very well be about the first engagement means 310. In FIG. 2*d*, the interconnecting means 330 is shown as having the second longitudinal surface 332 facing vertically up, i.e. away from the guiding arrangement 200. The opposite first longitudinal surface 331 of the interconnecting means 330 is facing vertically down, i.e. towards the guiding arrangement 200.

Figure 3A:
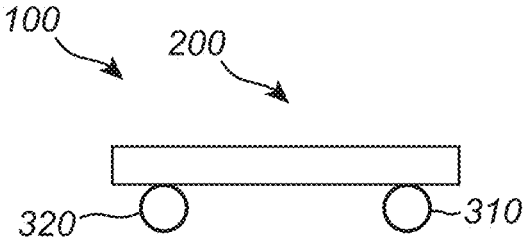
FIGS. 3*a-d* are schematic side views of an attachment arrangement according to embodiments of the present disclosure.
Figure 3B:
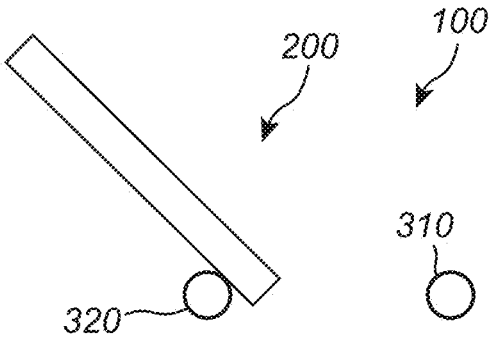
Figure 3C:
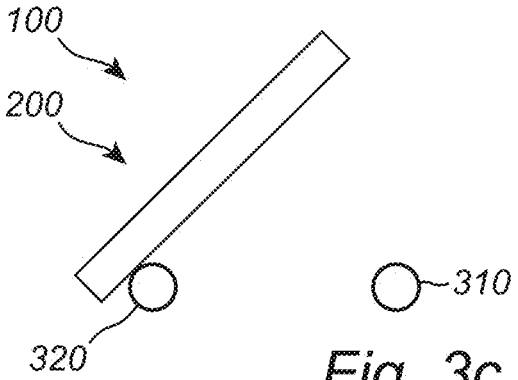
Figure 3D:
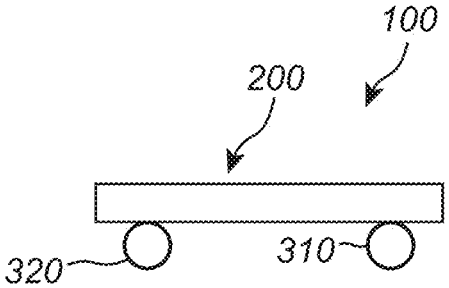

In FIGS. 3*a-d*, cross-sectional views of an alternative arrangement of the attachment arrangement 100 is shown. In this arrangement, the engaging arrangement 300 is attached to the supporting element 20 (not shown in FIGS. 3*a-d*) and the guiding arrangement 200 is attached to the structural element 20 (not shown in FIGS. 3*a-d*) of the piece of furniture 10. The transition from the first configuration (i), as shown in FIG. 3*a*, to the second configuration (ii), as shown in FIG. 3*d*, is analog to that described in connection with FIGS. 2*a-d* in that a translation T and a rotation R is executed on the supporting element 20. As the guiding arrangement 200 is attached to the supporting element 30 in this arrangement of the attachment arrangement 100, it is the guiding arrangement 200 that is subjected to the translation T and the rotation R. Assuming once more that the attachment arrangement 100 is comprised in a sofa and used to attach a structural element 20 in the form of a seat of the sofa to a supporting element 30 in the form a frame of the sofa. Assume further that the first engaging means 310 is arranged at the back of the sofa, i.e. towards the backrest of the sofa, and the second engaging means 320 is arranged at front of the sofa. In the embodiment of the attachment arrangement 100 shown in FIGS. 3*a-d*, the first engagement means 310 and the second engagement means 320 are attached directly to the supporting element 30 of the piece of furniture 10.

As seen in FIG. 3*b*, the transition is initiated by a translation T and/or a rotation R of the guiding arrangement 200, i.e. of the structural element 20 exemplified by the seat of a sofa. In this embodiment, as in the embodiment described above, the order of initiation of the translation T and rotation R is of no particular importance. Preferably, the seat is pulled forward out of the sofa causing the translation T of the guiding arrangement 200 such that it no longer is supported by the first engaging means 310. After this, the seat is lifted at the front of the sofa, which means that the guiding arrangement 200 is rotated R about the second engagement means 320, i.e. the rotation R.

As seen in FIG. 3*c*, the rotation R and the translation Tis continued until the guiding arrangement 200 is arranged at a side of the second engagement means 320 facing away from the first engagement means 310.

In FIG. 3*d*, attachment arrangement 100 is shown after the transition from the first configuration (i) into the second configuration (ii) has been completed. Compared to first configuration (i) of FIG. 3*a*, in the second configuration (ii), the guiding arrangement 200 is rotated 180 degrees.

The arrangement illustrated in FIGS. 2*a-d* wherein the engaging arrangement 300 is attached to the structural element 20 is the preferred arrangement, the skilled person will appreciate that the opposite arrangement shown in FIGS. 3*a-d* wherein the guiding arrangement 200 is attached to the structural element 20 is also possible. The focus of the present disclosure will be on the first arrangement, but the skilled person will readily understand, after contemplating the teachings herein, which embodiments and features that are also usable with the latter arrangement. In addition to this, the skilled person will, after digesting the present disclosure, readily be able to make any suitable modifications to the latter arrangement in order to make it workable with specific features, even when those suitable modifications are not explicitly presented herein.

In the description given with reference to FIGS. 2*a-d* and 3*a-d*, the structural element 20 is illustrated as being rotated clockwise. The rotation R and translation T described may very well repeated once more in the clockwise direction, i.e. starting by lifting an end of the seat (the structural element 20) distal to a back of the sofa. Repeating the translation T and rotation R would mean that the structural element 20 is rotated, as viewed in FIGS. 2*a-d* and 3*a-d*, clockwise 360° returning it to the orientation illustrated in FIGS. 2*a* and 3*a*. The same end result is accomplished by reversing the rotation R and translation T, i.e. performing the rotation R counter clockwise by lifting an end of the seat (the structural element 20) proximal to the back of the sofa. The references to clockwise and counter clockwise are in relation rotations about pivot points provided by the engagement means 310, 320 as seen in the views in FIGS. 2*a-d* and 3*a-d*.

In one embodiment, the transition from the first configuration (i) to the second configuration (ii) is performed by translation T rotation R in a first direction and the transition from the second configuration (ii) to the first configuration (ii) is performed by translation T and rotation R in a second direction, opposite the first direction. This means that the same engagements means 310, 320 will be the pivot point for the rotation R regardless if the transition is from the first configuration (i) to the second configuration (ii) or from the second configuration (ii) to the first configuration (ii).

In a preferred embodiment, the transition from the first configuration (i) to the second configuration (ii) is performed by translation T and rotation R in the first direction and the transition from the second configuration (ii) to the first configuration (ii) is also performed by translation T and rotation R in the first direction. This means that one engagements means 310, 320 will provide a pivot for the rotation R of the structural element 20 in the transition from the firs configuration (i) to the second configuration (ii), and another engagement means 310, 320 will provide a pivot point for the rotation R of the structural element 20 from the second configuration (ii) to the first configuration (ii). This is beneficial as the structural element 20 will always be lifted at the same end providing a more user friendly and intuitive setup and also the wear and tear of the engagement means 310, 320 will be substantially equal extending the product life time of the attachment arrangement 100.

As understood from the embodiments presented, the attachment arrangement 100 comprises at least two engagement means 310, 320. Further engagement means 310, 320 may very well be provided to e.g. divide the load of the structural element 20 between more contact points between the engaging arrangement 300 and the guiding arrangement 200. However, in a preferred embodiment, the attachment arrangement 100 comprises two engagement means 310, 320 and, as will be understood when all embodiments are presented, two engagement means 310, 320 are compatible with all embodiments herein.

The engagement means 310, 320 may, in some embodiments be substantially identical, and in other embodiments, different.

In some embodiments, one or both (or more) engagement means 310, 320 is/are a rolling engagement means. A rolling engagement means implies that a component of the engagement means is rotatable with respect to the structural element 20 or supporting element 30 to which is it attached. The rotation may be provided by friction between the rotating component of the engagement arrangement 300 and the longitudinal guiding arrangement 200 when the translation T of the structural element 20 occurs. The rotating component may be a wheel connected to the structural element 20 or the supporting element 30 by e.g. ball bearings etc. The rolling engagement means may be described as rolling in its engagement with the guiding arrangement 200.

In some embodiments, one or both (or more) engagement means 310, 320 is/are a sliding engagement means. A sliding engagement means implies that a component of the engagement means is slidably engaging the guiding arrangement 200 when the attachment arrangement 100 is used in a piece of furniture 10. The sliding between the engagement means and the guiding arrangement 200 is provided when the translation T of the structural element 20 occurs. The sliding engagement means may be described as sliding in its engagement with the guiding arrangement 200.

Figure 4:
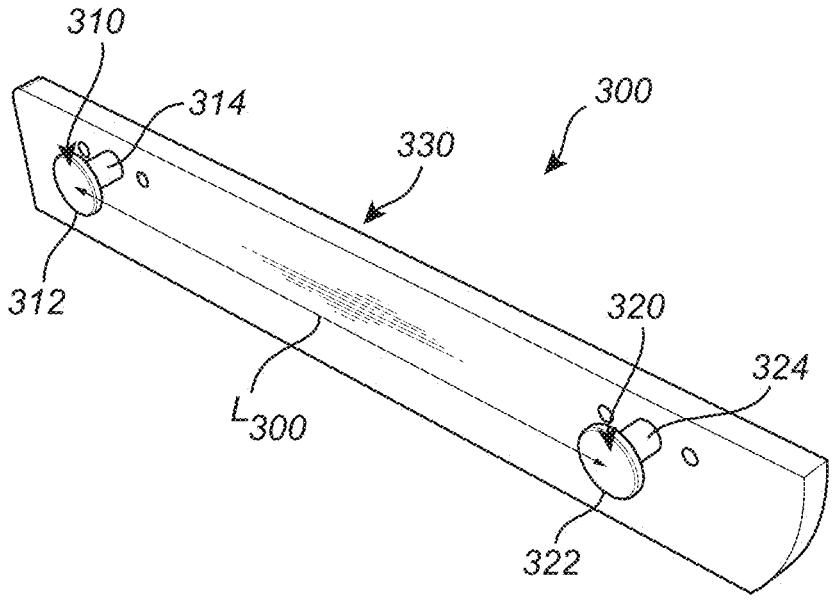
FIG. 4 is a perspective view of an engaging arrangement according to embodiments of the present disclosure.

In FIG. 4, one embodiment of an engaging arrangement 300 according to the teachings of the present disclosure is presented. The engaging arrangement 300 comprises a first engagement means 310 and a second engagement means 320 separated by a longitudinal distance $L_{300}$. The longitudinal distance $L_{300}$ may be defined as a center-to-center (cc) distance between the first engagement means 310 and a second engagement means 320. In the embodiment of FIG. 4, the engagement means 310, 320 are arranged on an interconnecting means 330, but as previously mentioned, this is purely optional and the engagement means 310, 320 may attached directly to the structural element 20 or to the supporting element 30. The first engagement means 310 comprises an engagement portion 312 connected to the interconnecting means 330 by a cylindrical portion 314. Analogously, the second engagement means 320 also comprises an engagement portion 322 connected to the interconnecting means 330 by a cylindrical portion 324. The engagement portions 312, 322 are, preferably, the parts of the engagement arrangement 300 that are in contact with the guiding arrangement 200. The engagement portions 312, 322 may be fixedly attached to the cylindrical portions 314, 324 in embodiments where the engagement means 310, 320 is a sliding engagement means 310, 320 as described above. In embodiments where the engagement means 310, 320 is a rolling engagement means 310, 320, the engagement means 310, 320 may be attached to the cylindrical portion 314, 324 by means of e.g. ball bearings etc. as described above. Alternatively, a rolling engagement means 310, 320 may be provided by forming a rolling attachment between the cylindrical portion 314, 324 and the interconnecting means 330, or the structural element 20 or supporting element 30 if applicable. In the latter example, the engagement portions 312, 322 are preferably fixed to the cylindrical portions 314, 324. The cylindrical portions 314, 324 are not necessarily cylindrical in shape, but may be any suitable shape or form. Generally, a diameter of the engagement portions 312, 322 is larger than a diameter of the cylindrical portions 314, 324.

Figure 5:
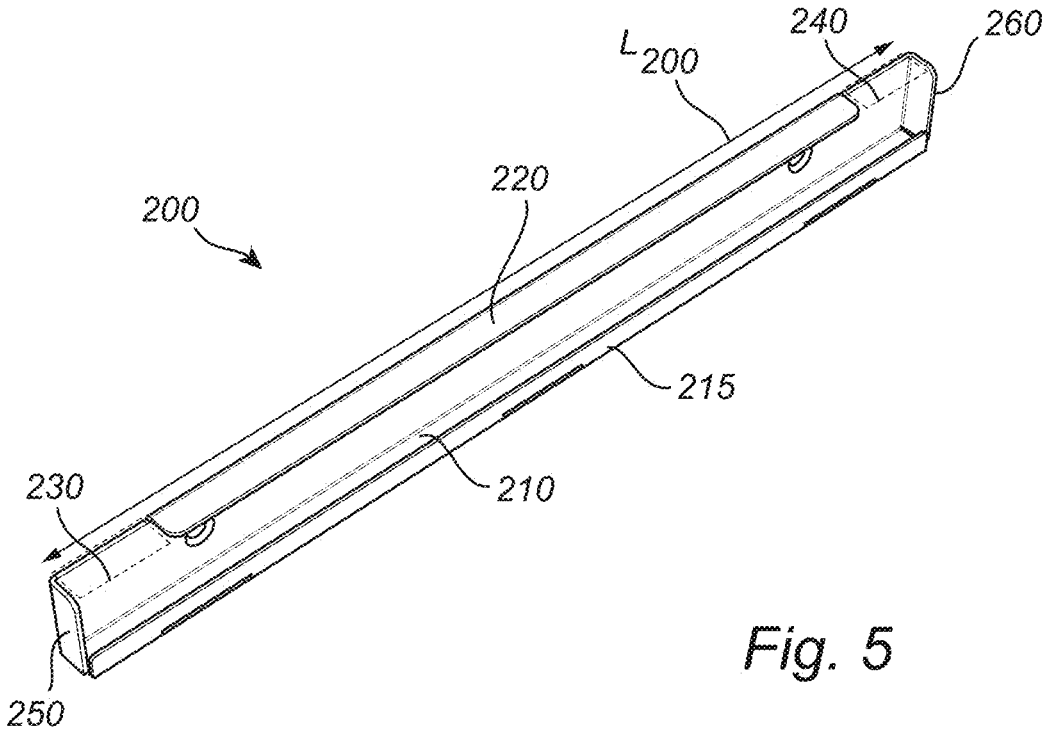
FIG. 5 is a perspective view of a guiding arrangement according to embodiments of the present disclosure.

In FIG. 5, one embodiment of a longitudinal guiding arrangement 200 is illustrated. The guiding arrangement 200 comprises a first longitudinal member 210. The engaging arrangement 300 will generally engage the first longitudinal member 210, i.e. the engagement means 310, 320, and specifically the engagement portion 312, 322 (if used) of the engaging arrangement 300 will typically contact the first longitudinal member 210. The first longitudinal member 210 may, in some embodiments, be provided with a guide rim 215 extending along the first longitudinal member 210 and being arranged at an angle to the first longitudinal member 210. The guide rim 215 is configured to prevent the engagement means 310, 320 from exiting the first longitudinal member in one direction along the extension of the cylindrical portion 314, 324. The structural element 20 or supporting element 30 that the guiding arrangement is attached to will prevent the engagement means 310, 320 from exiting the first longitudinal member in the other direction along the extension of the cylindrical portion 314, 324. In embodiment with the guide rim 215 and when the engaging arrangement 300 is engaging the guiding arrangement 200, the engagement portions 312, 322 of the engaging arrangements are sandwiched between the guide rim 215 and the one of the structural element 20 or supporting element 30 that the guiding arrangement 200 is attached to.

The guiding arrangement 200 may optionally be provided with longitudinal stop members 250, 260 (stop members for short) provided at longitudinal ends of the guiding arrangement 200. A first stop member 250 may be provided at one longitudinal end of the guiding arrangement 200 and a second stop member 260 may be provided at the other longitudinal end of the guiding arrangement 200. The stop members 250, 260 are configured to prevent the engagement means 310, 320 from traveling, during translation T, beyond the longitudinal extension of the first longitudinal member 210. The stop members 250, 260 are preferably arranged substantially transverse (substantially perpendicular) to the first longitudinal member 210 towards the engaging arrangement (when in engagement). The stop members 250, 260 are beneficial as they prevent the translation T to go beyond the longitudinal extension of the guiding arrangement 200. To exemplify, looking back to FIG. 2*a* and assuming that there is a first stop member 250 at the front of the sofa, i.e. to the left in FIG. 2*a*. This would mean that the only option to start a transition to the second configuration (ii) would be to lift the first engagement means 310 being adjacent to the first stop member 250 (not shown in FIG. 2*a*). As the translation T and rotation R continues, see FIG. 2*c*, the first stop member 250 (not shown in FIG. 2*c*) would prevent the second engagement means 320 to travel beyond the longitudinal extension of the guiding arrangement 200 such that the rotation R may be completed without risking a too long translation T. Returning to FIG. 5, the second stop member 260 may similarly be provided to prevent the engaging arrangement 300 to travel beyond the guiding arrangement 300 at the other longitudinal end of the guiding arrangement 300.

The guiding arrangement 200 in FIG. 5 is further provided with an optional second longitudinal member 220. The second longitudinal member 220 is substantially parallel to the first longitudinal member 210. A distance between the first longitudinal member 210 and the second longitudinal member 220 is adapted such that the engagement means 310, 320 of the engaging arrangement 300 may be sandwiched between the first longitudinal member 210 and the second longitudinal member 220 during the translation T. That is to say, the engagement means 310, 320 engaging the guiding arrangement 200 during the translation T is sandwiched between the first longitudinal member 210 and the second longitudinal member 220 for at least a portion of the translation T. In embodiments of the engaging arrangement 300 wherein the engagement means 310, 320 are provided with engagement portions 312, 322, the distance between the first longitudinal member 210 and the second longitudinal member 220 is preferably slightly larger than the diameter of the engagement portions 312, 322 to allow translation T without undue friction and also permit a rolling engagement means to freely rotate between the longitudinal members 210, 220. The second longitudinal member 220 may be arranged to prevent undesired rotation R of the engaging arrangement 300 when it is engaging the guiding arrangement 200. Particularly, during rotation R, the second longitudinal member 220 prevents the engagement means 310, 320 currently out of engagement with the guiding arrangement 300 from being lifted from the guiding arrangement. In the case of the sofa in FIG. 2*c*, this means that the second engagement means 320 is retained at a substantially constant horizontal position throughout the transformation from the first configuration (i) to the second configuration (ii) as illustrated in FIGS. 2*b* and 2*c*.

In the embodiment in FIG. 5, the second longitudinal member 220 is longitudinally shorter than the first longitudinal member 210. The second longitudinal member 220 is parallel to the first longitudinal member and arranged with a longitudinal center substantially aligned with a longitudinal center of the first longitudinal member 210. This arrangement provides longitudinal openings 230, 240 in the guiding arrangement 200. In embodiments comprising the longitudinal stop members 250, 260, as the one in FIG. 5, the longitudinal openings 230, 240 are provided, between the longitudinal stop members 250, 260 and the second longitudinal member 220. A longitudinal distance $L_{200}$ between a first longitudinal opening 230 at one longitudinal end of the second longitudinal member 220 and a second longitudinal opening 240 at the other longitudinal end of the second longitudinal member 220 is preferably adapted to match the longitudinal distance $L_{300}$ between the first engagement means 310 and the second engagement means 320. Preferably, the longitudinal extension of the second longitudinal member 220 is shorter than a shortest longitudinal distance between the engagement means 310, 320, i.e. the longitudinal distance $L_{300}$ between the engagement means 310, 320 minus two times a radius of the engagement portions 312, 322. This will permit the engaging arrangement 300 to be inserted into the guiding arrangement 200, i.e. arranged in engagement with the first longitudinal member 210 of the guiding arrangement 200, in a direction transversal to the longitudinal extension of the first longitudinal member 210 and the second longitudinal member 220.

It should further be mentioned that the first longitudinal member 210 and/or the second longitudinal member 220 may be formed with a U-shaped cross-section providing guide rims 215 (only shown for the first longitudinal member 210). Preferably, the U-shaped cross-section is adapted to engage the engagement portions 312, 322 of the engagement means 310, 320 effectively retaining the engagement means 310, 320 and preventing movement in a direction along the extension of cylindrical portions 314, 324 of the engagement means 310, 320.

It should be mentioned that the features listed above with reference to guiding arrangement 200 illustrated in FIG. 5 may very well be separated as individual features and must not be combined in one embodiment. That is to say, the stop members 250, 260 may be selected for an embodiment without having to include e.g. the second longitudinal member 220 and the second longitudinal member 220 may be selected for another embodiment without having to include the stop members 250, 260, the guide rim 215 and/or the longitudinal openings 230, 240. However, the embodiment of the guiding arrangement 200 illustrated in FIG. 5 provides excellent guiding for an associated engaging arrangement 300.

Figure 6:
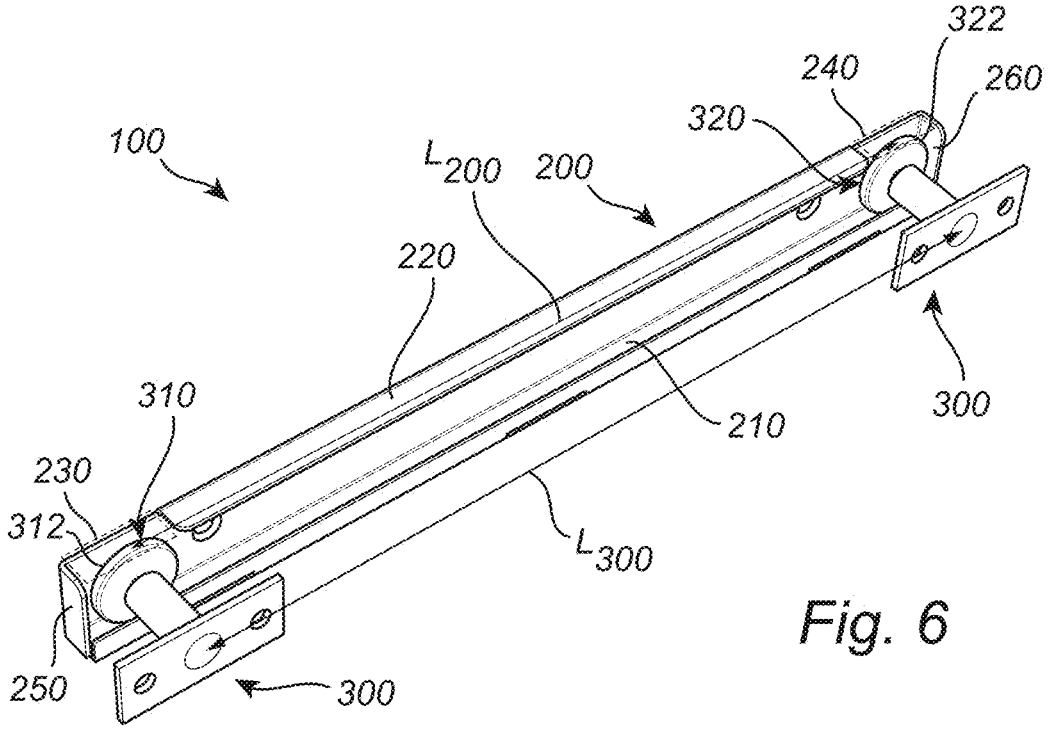
FIG. 6 is a perspective view of a guiding arrangement in engagement with an associated engaging arrangement according to embodiments of the present disclosure.

In FIG. 6 the same corresponding guiding arrangement 200 as shown in FIG. 5 is depicted but in engagement with an associated engaging arrangement 300. To exemplify the benefits of the features of the attachment arrangement 100, In FIG. 6, the first engagement means 310 will be allowed to exit the guiding arrangement 200 through the first opening 230 whilst the second engagement means 320 will be kept sandwiched in the guiding arrangement. The second engagement means 320 will be permitted to, rolling or slidingly, move along the guiding arrangement 200 sandwiched between the first longitudinal member 210 and the second longitudinal member 220 during the translation T when changing configuration of to the piece of furniture 10. The translation T will be stopped when the second engagement means 320 reaches the first longitudinal stop member 250 at which point a full 180° rotation R will allow the first engagement means 310 to once more come in contact with the first longitudinal member 210 through the second opening 240.

The guiding arrangement 200 of the present disclosure may be formed from any suitable material. However, preferably the guiding arrangement 200 is made from metal. It may be beneficial to form the guiding arrangement from a sheet metal shaped (e.g. cut) such that it may be folded to form e.g. the first longitudinal member 210 and (if present) the second longitudinal member 220, (if present) the guide rims 215 and/or (if present) the stop members 250, 260. This is beneficial as a strong, yet cost effective, guiding arrangement is provided.

With reference to FIGS. 7*a-d*, the transformation, i.e. reconfiguration, change of mode, change of operable configuration etc., of a piece of furniture 10 in the form of a sofa from the first configuration (i) to the second configuration (ii) will be illustrated. The structural element 20 is illustrated as a seat, but may, as previously explained, be the backrest. The engaging arrangement 300 is attached to the structural element 20 and the guiding arrangement 200 is attached to the supporting element 30. The engaging arrangement 300 is not attached centrally with regards to thickness extension $h_{20}$, or height, of the structural element 20. The engaging arrangement 300 is, in other words, arranged off-centered to the thickness extension $h_{20}$ of the structural element 20. This will result in different heights of the structural element 20 depending on the configuration of the piece of furniture 10. That is to say, in the first configuration (i), a top surface of the seat may be at a first distance from a floor on which the sofa stands, and in the second configuration (ii), the seat may be at a second distance from the floor, wherein the second distance is longer than the first distance. A seated height of a person sitting in the sofa will be higher in the second configuration (ii) than in the first configuration (ii).

Figure 7A:
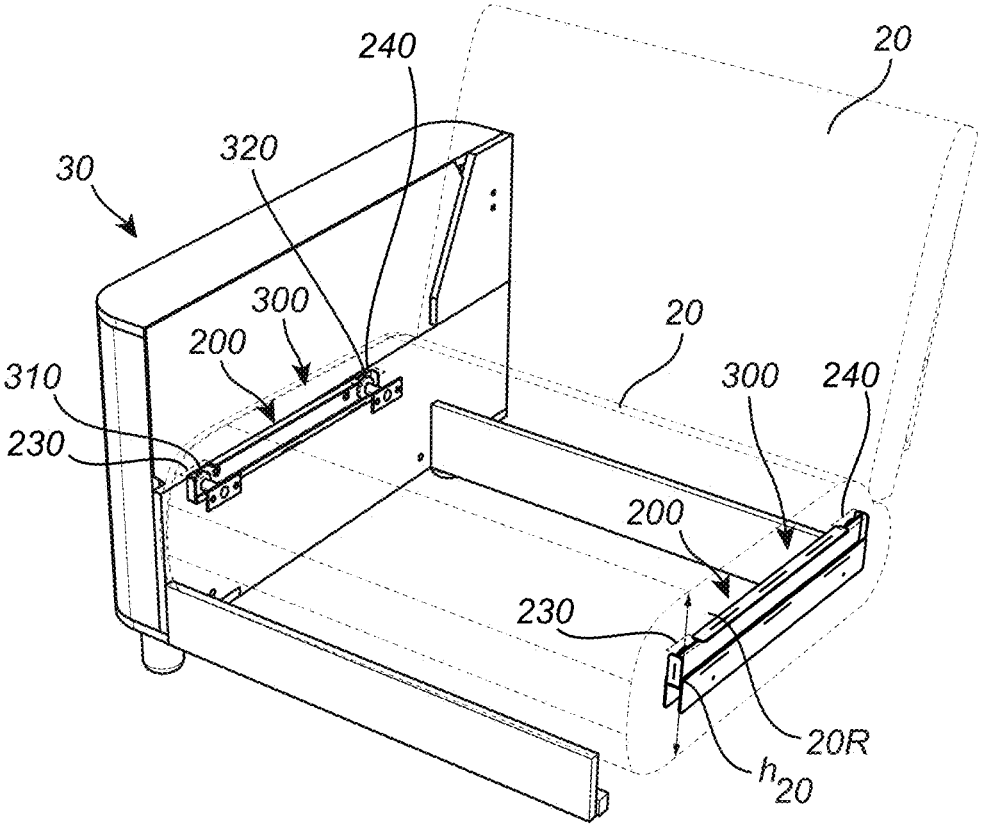
FIGS. 7*a-d* are partial perspective views of a piece of furniture comprising an attachment arrangement according to embodiments of the present disclosure.
Figure 7B:
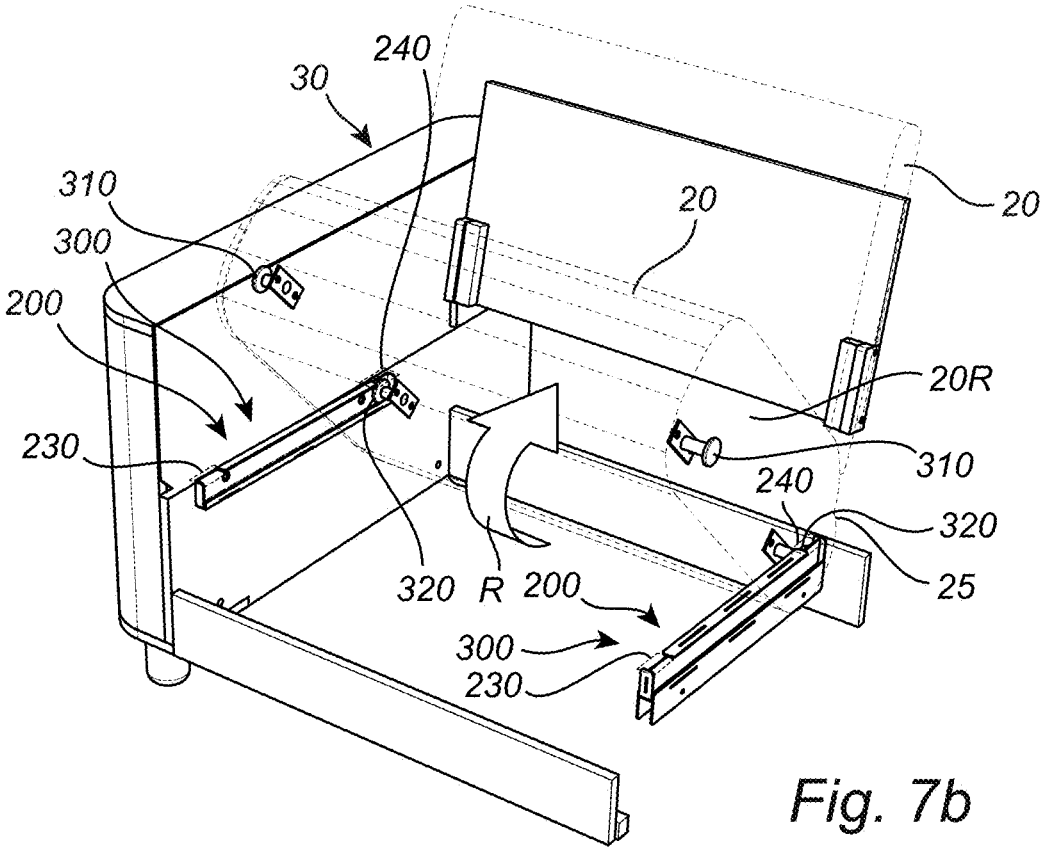

In FIG. 7*b*, the transformation of the piece of furniture 10 is initiated by rotation R about the second engagement means 320. This is accomplished by lifting the end of the structural element 20, the seat, being closest to the first engagement means 310 such that the first engagement means 310 may pass through the first longitudinal opening 230.

Figure 7C:
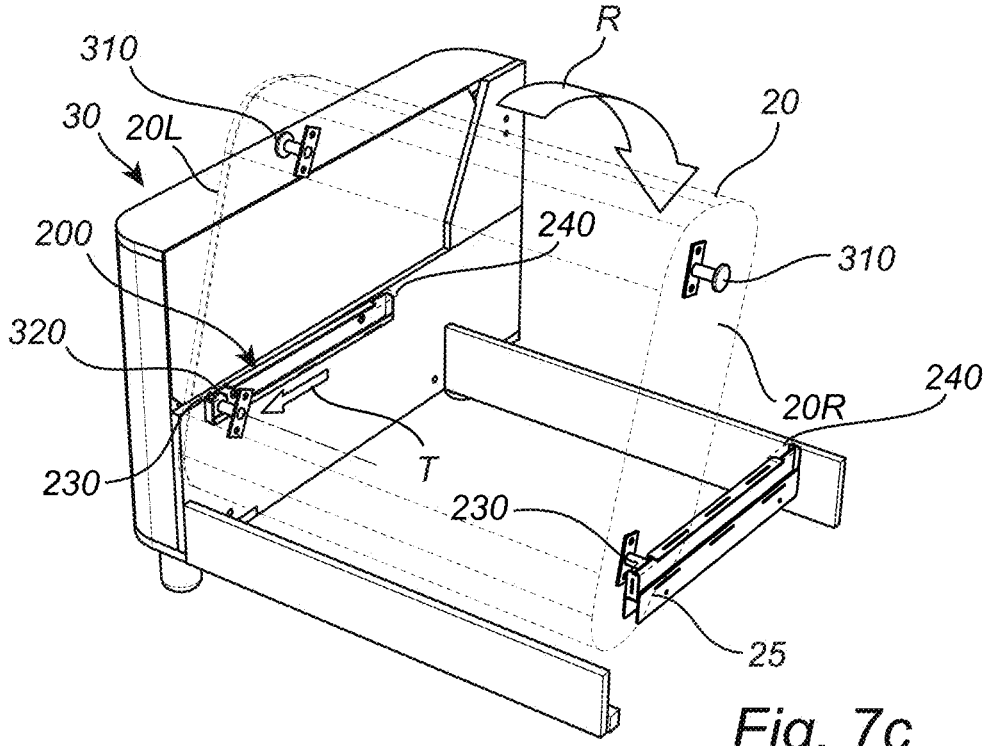

In FIG. 7*c*, the rotation R about the second engagement means 320 is continued and the second engagement means 320 is translated T towards the first longitudinal opening 230, i.e. towards the end of the guiding arrangement 200 at which the first engaging means 310 was located before the transformation from the first configuration (i) to the second configuration (ii) was initiated.

Figure 7D:
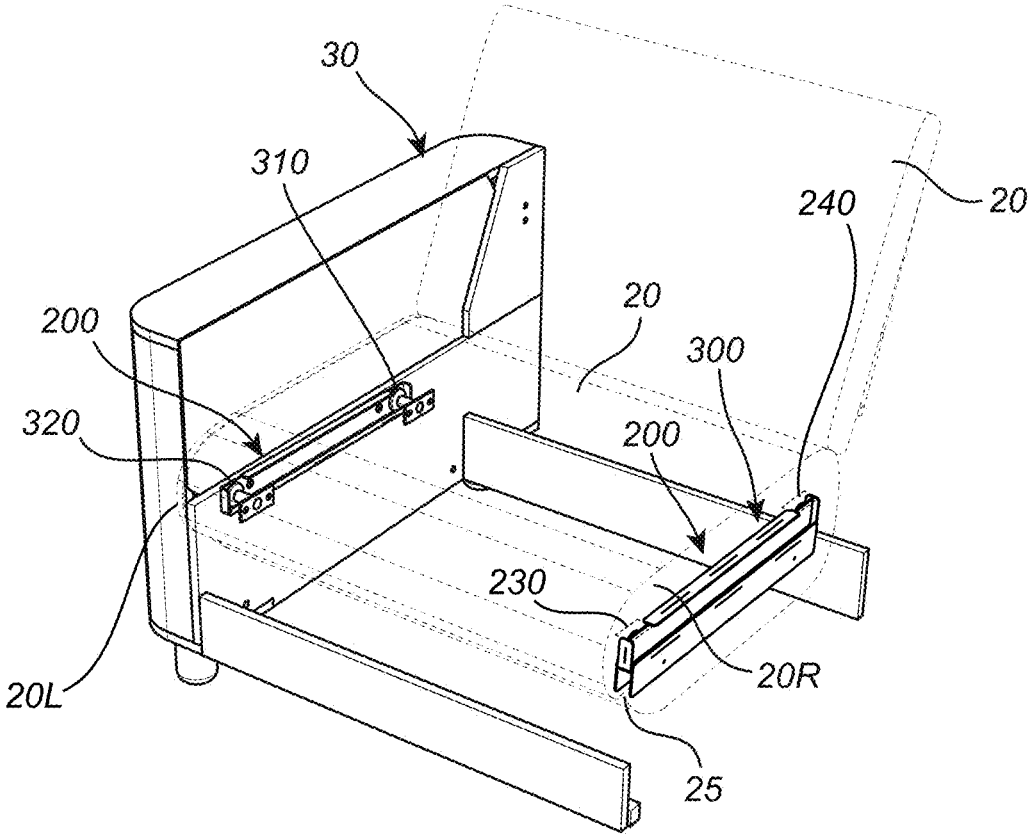

In FIG. 7*d*, the piece of furniture is shown in the second configuration, i.e. with transformation from the first configuration (i) to the second configuration (ii) completed. The first engaging means 310 has entered the guiding arrangement 200 through the second longitudinal opening 240.

As seen in FIGS. 7*a-d*, the seat is provided with a chamfer 25 at one end of the seat, i.e. the structural element 20. This chamfer 25 is beneficial when the attachment arrangement 100 is used in a seating furniture with a backrest. A seating furniture may describe any piece of furniture one may sit on such as, but not limited to, sofas, armchairs, loveseats, couches, chairs, stools etc. The chamfer 25 is especially beneficial in embodiments wherein the part of the attachment arrangement attached to the structural element 20 in the form of a seat is offset with regards to the thickness extension $h_{20}$ of the structural element 20. The chamfer 25 will fit under the backrest when the seat is in a higher, i.e. raised sitting position. When the seat is in the lower sitting position, the chamfer 25 will allow the seat to extend into the sofa whilst still supporting the legs of a person sitting on the sofa.

Figure 8:
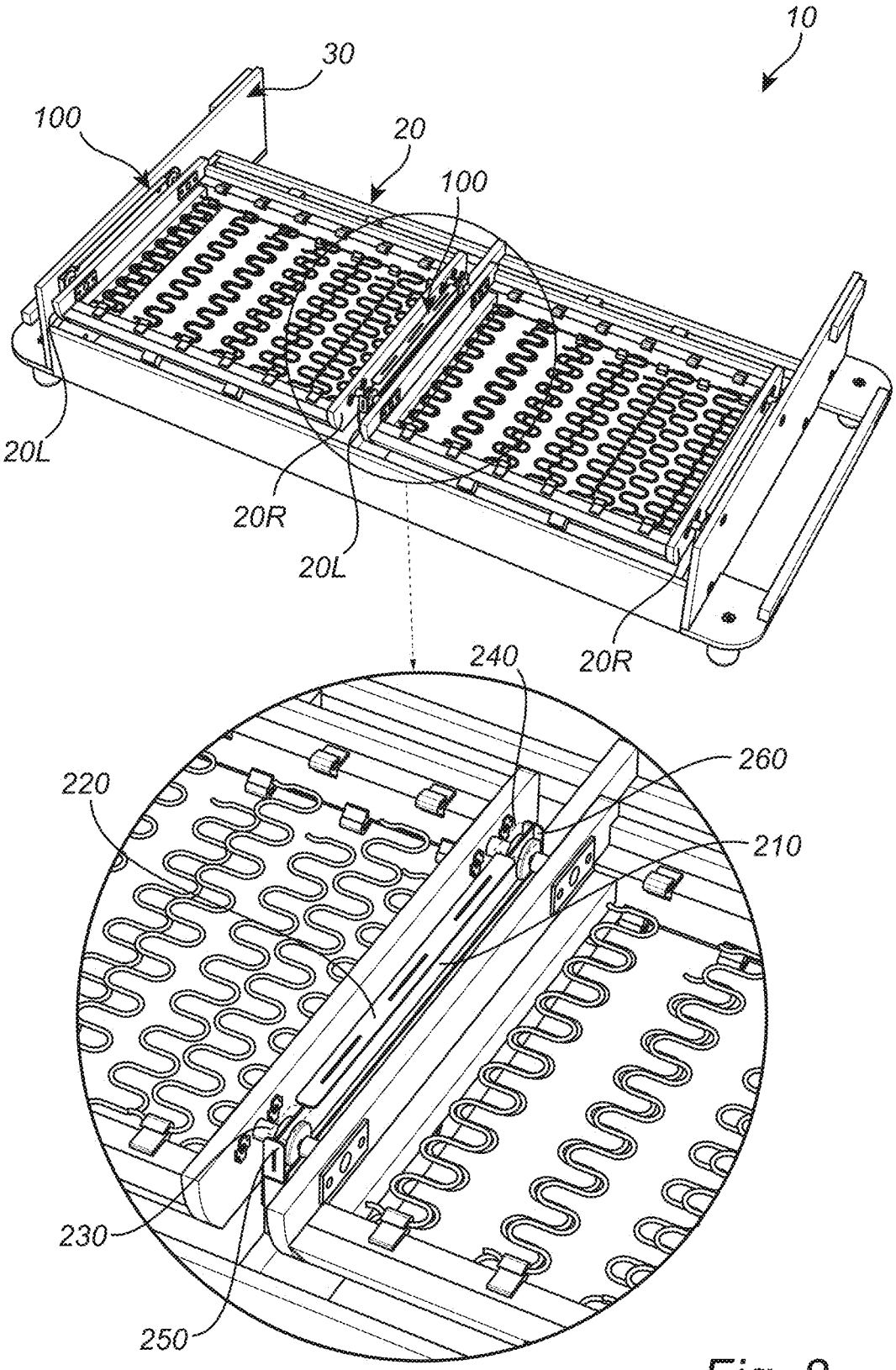
FIG. 8 is a partial perspective view of a piece of furniture comprising an attachment arrangement according to embodiments of the present disclosure.

With reference to FIG. 8, a preferred embodiment of a piece of furniture 10 according to the teachings of the present disclosure will be presented. The view of FIG. 8 is a partial view of a two-seat sofa showing the sitting section of the sofa with padding removed. Each of the two seats of the sofa are operable in two different configurations, i.e. the seats are the structural elements 20, as described herein. Each of the seats is attached to the frame of the sofa, i.e. the supporting element 30 as taught herein, by two attachment arrangements 100, one at each side 20L, 20R of the seat. In FIG. 8, the attachment arrangements 100 are shown as substantially equal (with the exception of the middle guiding arrangement 200 which is discussed in the following section) at both sides 20L, 20R of the structural element 20. However, this is but one embodiment, and in some embodiments, the attachment arrangements 200 at each side 20L, 20R of the structural element 20 may be different. In one embodiment, only one of the attachment arrangements 100 of a structural element 20 may be provided with the second longitudinal member 220, the stop members 250, 260 and/or the longitudinal openings 230, 240.

As illustrated in FIG. 8, the guiding arrangement 200 arranged between the seats of the sofa may be a doubled guiding arrangement 200. The doubled guiding arrangement 200 is illustrated in the magnified section in FIG. 8. The doubled guiding arrangement 200 may be formed by any guiding arrangement 200 presented herein, and the one shown in FIG. 8 is a doubled guiding arrangement 200 based on the guiding arrangement shown in FIG. 5. Basically, the doubled guiding arrangement 200 is a combination of two guiding arrangements, mutually mirrored (or rotated if they are symmetrical) in a plane extending between the first longitudinal member 210 and the second longitudinal member 220. The doubled guiding arrangement 200 is beneficial as it allows two engaging arrangement 300 to engage it simultaneously, one at each side.

Modifications and other variants of the described embodiments will come to mind to one skilled in the art having benefit of the teachings presented in the foregoing description and associated drawings. Therefore, it is to be understood that the embodiments are not limited to the specific example embodiments described in this disclosure and that modifications and other variants are intended to be included within the scope of this disclosure. For example, while embodiments of the invention have been described with reference mainly to a seat of a sofa with the guiding arrangement attached to the frame of the sofa, persons skilled in the art will appreciate that the embodiments of the invention can equivalently be applied to other parts of furniture and with the positon of the guiding arrangement and the engaging arrangement reversed. Furthermore, although specific terms may be employed herein, they are used in a generic and descriptive sense only and not for purposes of limitation. Therefore, a person skilled in the art would recognize numerous variations to the described embodiments that would still fall within the scope of the appended claims. Furthermore, although individual features may be included in different claims (or embodiments), these may possibly advantageously be combined, and the inclusion of different claims (or embodiments) does not imply that a combination of features is not feasible and/or advantageous. In addition, singular references do not exclude a plurality. Finally, reference signs in the claims are provided merely as a clarifying example and should not be construed as limiting the scope of the claims in any way.

The invention claimed is:

1. An attachment arrangement for attaching a structural element to a supporting element of a piece of furniture operable between multiple configurations, the attachment arrangement comprising:

a longitudinal guiding arrangement for attachment to one of the structural element or the supporting element; and an engaging arrangement for attachment to the other of the structural element or the supporting element;

the engaging arrangement comprising a first engagement member and a second engagement member operable to, when used in the piece of furniture, engage the longitudinal guiding arrangement to provide a translation and a rotation of the structural element in relation to the supporting element between a first configuration and a second configuration of the piece of furniture, wherein the longitudinal guiding arrangement or the engaging arrangement attached to the structural element is arranged off-centered with respect to, and within a lower one-third of, a thickness of the structural element.

2. The attachment arrangement of claim 1, when used in the piece of furniture, the first engagement member is configured to provide a pivot point for rotation from the first configuration to the second configuration, and the second engagement member is configured to provide a pivot point for rotation from the second configuration to the first configuration.

3. The attachment arrangement of claim 1, wherein the first engagement member and/or the second engagement member is a rolling engagement member.

4. The attachment arrangement of claim 1, wherein the first engagement member and/or the second engagement member is a sliding engagement member.

5. The attachment arrangement of claim 1, wherein the longitudinal guiding arrangement is provided with a first longitudinal member operable to, when used in the piece of furniture, support the engaging arrangement.

6. The attachment arrangement of claim 5, wherein the longitudinal guiding arrangement is further provided with a second longitudinal member arranged substantially parallel to the first longitudinal member, wherein the longitudinal guiding arrangement is operable to, when used in the piece of furniture, sandwich one of the first engagement member or the second engagement member of the engaging arrangement between the first longitudinal member and the second longitudinal member during the translation of the structural element in relation to the supporting element.

7. The attachment arrangement of claim 6, wherein the second longitudinal member is shorter than the first longitudinal member providing a longitudinal opening in the longitudinal guiding arrangement through which, when used, the first engagement member and the second engagement member are operable to pass.

8. The attachment arrangement of claim 7, comprising two longitudinal openings, wherein one longitudinal opening is provided at each longitudinal end of the longitudinal guiding arrangement and a longitudinal distance between the two longitudinal openings is the same as a longitudinal distance between the first engagement member and the second engagement member.

9. The attachment arrangement of claim 6, wherein the first longitudinal member and/or the second longitudinal member is formed with a U-shaped cross-section.

10. The attachment arrangement of claim 1, wherein the longitudinal guiding arrangement is provided with a longitudinal stop member configured to prevent at least one of the first engagement member or the second engagement member from, when engaging the longitudinal guiding arrangement, travel beyond the longitudinal stop member.

11. A piece of furniture operable between multiple configurations, the piece of furniture comprising the structural element, the supporting element and the attachment arrangement according to claim 1 configured to attach one side of the structural element to the supporting element and to provide the translation and the rotation of the structural element in relation to the supporting element between the first configuration and the second configuration of the piece of furniture.

12. The piece of furniture of claim 11, comprising two attachment arrangements, one arranged at each side of the structural element and configured to attach the structural element to the supporting element.

13. The piece of furniture of claim 11, wherein the structural element is formed with a chamfer at one end along an extension of the attachment arrangement.

14. The piece of furniture according to claim 11, wherein one or more of the longitudinal guiding arrangement are attached to the supporting element.

15. The piece of furniture according to claim 11, wherein the piece of furniture is a seating furniture comprising one or more seats and one or more backrests.

16. The piece of furniture according to claim 15, wherein at least one of said one or more seats is the structural element attached to the supporting element by the attachment arrangement.

17. The piece of furniture according to claim 15, wherein at least one of said one or more backrests is the structural element attached to the supporting element by the attachment arrangement.

18. The attachment arrangement of claim 1, wherein the structural element comprises two sides extending between a first end and a second end of the structural element, the two sides being opposite to one another and defining a width of the structural element, wherein the longitudinal guiding arrangement or the engaging arrangement is attached to one of the two sides of the structural element, wherein the structural element is formed with a chamfer at the first end or the second end of the structural element along the width of the structural element.

19. An attachment arrangement for attaching a structural element to a supporting element of a piece of furniture operable between multiple configurations, the attachment arrangement comprising:

a longitudinal guiding arrangement for attachment to one of the structural element or the supporting element, and an engaging arrangement for attachment to the other of the structural element or the supporting element;

the engaging arrangement comprising a first engagement member and a second engagement member operable to, when used in the piece of furniture, engage the longitudinal guiding arrangement to provide a translation and a rotation of the structural element in relation to the supporting element between a first configuration and a second configuration of the piece of furniture, wherein the structural element comprises two sides extending between a first end and a second end of the structural element, the two sides being opposite to one another and defining a width of the structural element, wherein the longitudinal guiding arrangement or the engaging arrangement is attached to one of the two sides of the structural element, wherein the structural element is formed with a chamfer at the first end or the second end of the structural element along the width of the structural element.

* * * * *